US008051612B2

(12) United States Patent
Woodard

(10) Patent No.: US 8,051,612 B2
(45) Date of Patent: Nov. 8, 2011

(54) WALL SYSTEM HAVING BIASING MEMBERS RETAINING PANELS TO POSTS THAT ARE SECURED BY ANCHORING STRUCTURE

(76) Inventor: Kramer E. Woodard, Albuquerque, NM (US)

( * ) Notice: Subject to any disclaimer, the term of this patent is extended or adjusted under 35 U.S.C. 154(b) by 0 days.

(21) Appl. No.: 11/972,543

(22) Filed: Jan. 10, 2008

(65) Prior Publication Data

US 2008/0163569 A1 Jul. 10, 2008

Related U.S. Application Data

(60) Provisional application No. 60/884,302, filed on Jan. 10, 2007.

(51) Int. Cl.
*E02D 27/42* (2006.01)
*E04B 2/62* (2006.01)
*E04B 1/24* (2006.01)

(52) U.S. Cl. ..... 52/169.9; 52/773; 52/775; 52/780; 52/781

(58) Field of Classification Search ..... 52/766, 52/773, 775, 780, 781, 781.3, 169.1, 169.2, 52/169.9
See application file for complete search history.

(56) References Cited

U.S. PATENT DOCUMENTS 508,501 A * 11/1893 Orittenden et al. ..... 52/349
859,635 A * 7/1907 Webster ..... 52/549
1,154,511 A * 9/1915 Harstad ..... 52/264
1,582,865 A * 4/1926 Bristol ..... 220/602
1,661,128 A * 2/1928 Mankedick ..... 52/293.3
1,873,350 A * 8/1932 Smith ..... 52/770
2,099,589 A * 11/1937 Armbruster ..... 52/317
2,125,394 A * 8/1938 Neuendorf ..... 52/773
2,171,319 A * 8/1939 Williams ..... 52/464
2,438,140 A * 3/1948 Auten ..... 52/464
2,497,515 A * 2/1950 Pearse ..... 52/204.599
2,554,418 A * 5/1951 Mortenson ..... 52/479
2,638,191 A * 5/1953 Menosky ..... 52/773
2,803,321 A * 8/1957 Fox-Williams ..... 52/464
2,838,148 A * 6/1958 Fox-Williams et al. ..... 52/773
2,865,063 A * 12/1958 Hartshorn ..... 52/773
3,210,808 A * 10/1965 Creager ..... 52/204.705
3,224,155 A * 12/1965 Rook ..... 52/592.6
3,264,020 A * 8/1966 De Ridder ..... 52/282.1
3,350,829 A * 11/1967 Dalby ..... 52/781
3,397,495 A * 8/1968 Thompson et al. ..... 52/241
3,487,601 A * 1/1970 James ..... 52/204.597
3,514,916 A * 6/1970 Hoverman, Jr. ..... 52/204.597
3,600,864 A * 8/1971 Godley et al. ..... 52/235
3,674,082 A * 7/1972 Letarte ..... 160/371
3,834,106 A * 9/1974 Astedt et al. ..... 52/506.07
3,950,900 A * 4/1976 Simpson ..... 52/22
3,978,554 A * 9/1976 Miller, Jr. ..... 52/712
3,982,371 A * 9/1976 Preu ..... 52/773
4,143,495 A * 3/1979 Hintz ..... 52/145
4,283,891 A * 8/1981 Moeller ..... 52/144
4,479,339 A * 10/1984 Kroh ..... 52/468
4,621,477 A * 11/1986 Kinst ..... 52/780
4,793,106 A * 12/1988 Jonsson ..... 52/204.53

(Continued)

*Primary Examiner* — Michael Safavi
(74) *Attorney, Agent, or Firm* — The Adams Law Firm

(57) ABSTRACT

A wall system suitable for use in applications such as a fence or a wall of a building which comprises posts and panels which are interconnected or interengaged so that the wall may comprise a series of inline panels or corners formed by two panels and a single post, the interconnection or interengagement of the panels being effected without use of mechanical fasteners, glue, welding, or similar modes of attachment.

2 Claims, 12 Drawing Sheets

U.S. PATENT DOCUMENTS 4,873,809 A * 10/1989 Paul ..... 52/506.07
5,139,846 A * 8/1992 Herwegh et al. ..... 428/119
5,251,418 A * 10/1993 Jacobs et al. ..... 52/455
5,392,572 A * 2/1995 Elmore et al. ..... 52/144
5,410,853 A * 5/1995 Hartleif ..... 52/773
5,444,953 A * 8/1995 Koenig et al. ..... 52/282.1
6,042,301 A * 3/2000 Sovran ..... 405/112

* cited by examiner

WALL SYSTEM HAVING BIASING MEMBERS RETAINING PANELS TO POSTS THAT ARE SECURED BY ANCHORING STRUCTURE

CROSS-REFERENCE TO RELATED APPLICATION

This application claims priority to and the benefit of the filing of U.S. Provisional Patent Application Ser. No. 60/884,302 entitled Panel System and the specification thereof is incorporated herein by reference.

BACKGROUND OF THE INVENTION

This invention relates to a wall system comprising one or more posts and one or more panels which may be easily interconnected by unskilled labor providing a very cost effective wall system that can be quickly and inexpensively installed.

Wall systems are used for a variety of purposes, such as a fence in outdoor applications, or interior or exterior walls of a building for commercial, office or residential use. Wall systems typically include posts forming vertical structural members for corners where walls intersect typically at a right angle or intermediate the ends as structural members between adjoining panels that are coplanar. Both walls and fences may have various lengths and thus may be assembled from a plurality of intermediate posts and interconnected panels. Such wall systems may utilize pre-fabricated panels fabricated from a variety of materials or the panels may be assembled on site. A number of means for connecting the panels to a post have been utilized including fasteners such as rivets, screws, and nails, or in the case of metal, posts and panels, by welding, brazing or similar metal joining methods.

Fences are typically constructed from wooden materials, utilizing wooden fence posts and panels of wooden construction. The fabrication of the panel may be on site by using upper and lower stringers between a pair of spaced apart posts and then assembling wooden boards between the stringers to form the panel. Or the panel may be prefabricated as a single unit having upper and lower rails and vertical end portions fastened at their upper and lower ends to the rails with the center portion of the panel comprising a variety of materials such as wood slats, arranged in vertical or horizontal position, and forming a solid surface or spaced apart slats or boards. The panel may also be constructed of a variety of materials other than wood.

Despite the use of wall systems in various applications for many years, the present wall system has advantages over such prior art systems as will become clear from the following description.

SUMMARY OF THE INVENTION

This invention comprises a wall system including one or more posts and panels, each panel having vertical end portions with a given thickness, each post comprising a first elongated substantially flat member, a second elongated substantially flat member attached at one proximal longitudinal edge to a first lateral location adjacent one longitudinal edge of the first member, a third elongated substantially flat member attached at one proximal longitudinal edge to the first member at a laterally spaced location from the first location, the distal edges of the second and third elongated members spaced a predetermined distance that is less than the thickness of the panel end portions, and at least one of said second or third elongated flat members being resilient, whereby the end portion of the panel may be inserted between the distal edges of the second and third elongated members and is clampingly retained therebetween.

BRIEF DESCRIPTION OF THE DRAWINGS

The present invention will be further understood from the following description with reference to the drawings in which.

DETAILED DESCRIPTION

Figure 1:
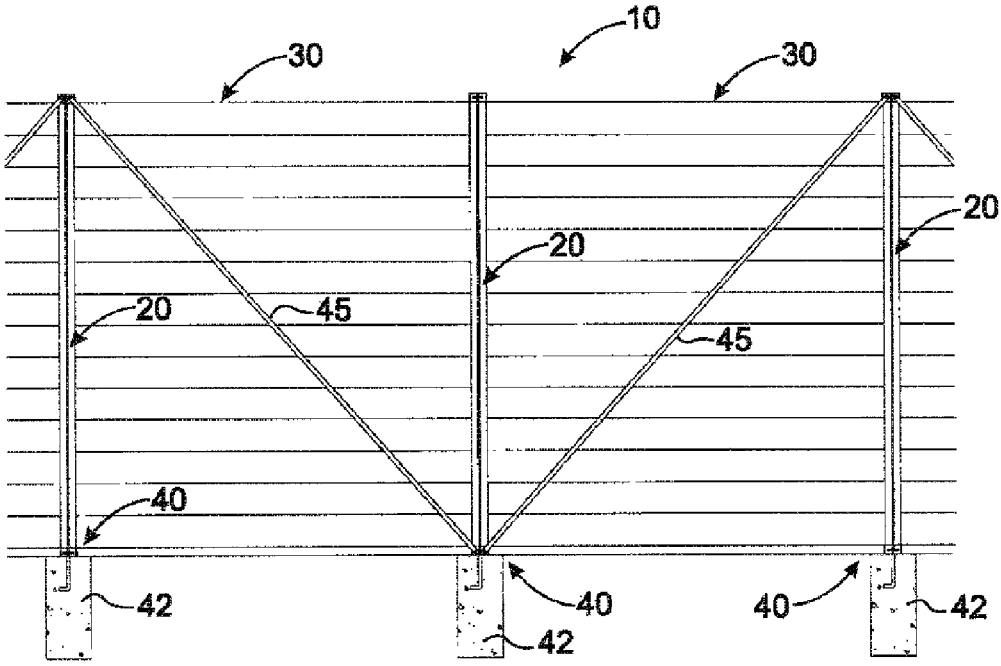
FIG. 1 illustrates an elevation view of one embodiment of a wall system in accordance with the present invention.

The wall system of the present invention is useful in many applications, two of which are shown in FIGS. 1 and 2. In FIG. 1, the wall system comprises a portion of a fence 10 and as shown comprises three identical posts 20 and two identical wall panels indicated at 30. The posts 20 are vertically oriented and are spaced apart so as to received the panels 30. The panels 30 are of a general rectangular configuration having two vertical end portions that engage the posts 20. The wall panels may be fabricated from a wide variety of materials including metal, plastic, fiberglass, composite materials, or other suitable materials which may be formed in a single monolithic panel, or comprised of numerous individual longitudinally extending horizontal or vertical slats formed from material such as wood. Preferably, the panels are pre-fabricated and available in various heights and lengths as well as different thicknesses depending upon the application and other structural requirements of the panel.

The posts 20 for the fence 10 are embedded in the soil either directly or through an anchoring structure 40 which may comprise a concrete footing 42 poured into an opening in the ground and retaining a post 20 which has its lower end embedded in the concrete 42 as will be explained in greater detail in reference to FIG. 14. Depending upon the type of fence and the environmental conditions it may be desirable to strengthen the wall panels through the use of cross wires, bars, or straps such as shown at 45. It will be understood by those having ordinary skill in the art that cross bracing may be unnecessary and it will also be appreciated that there are a variety of anchoring structures that may be used for the post of the fence 10.

Figure 2A:
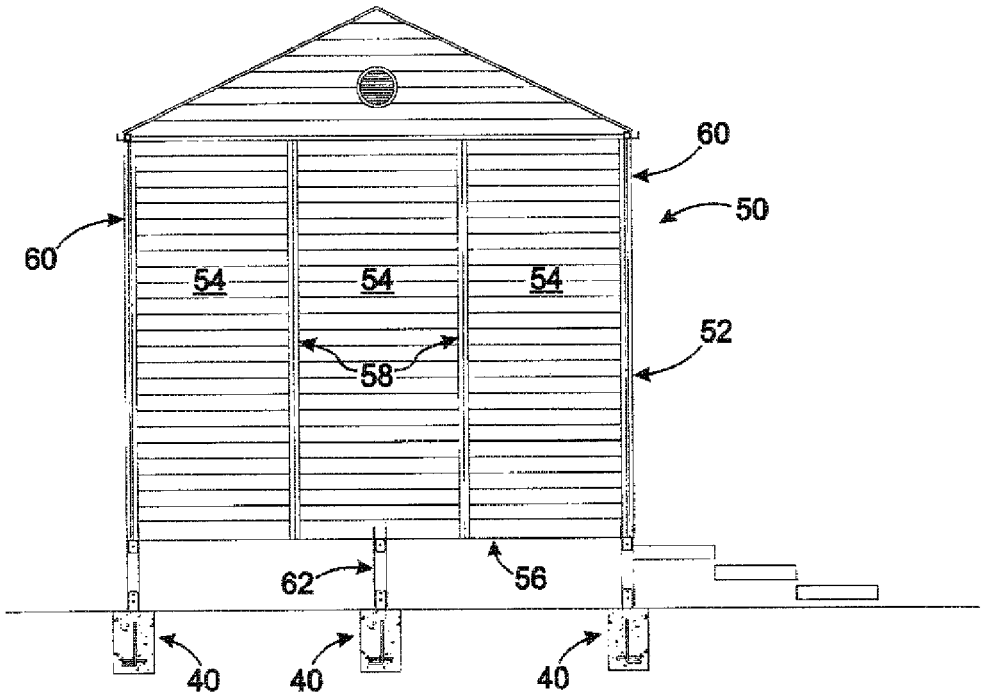
FIG. 2A is an elevation view of one embodiment of a building having walls constructed in accordance with the present invention.
Figure 2B:
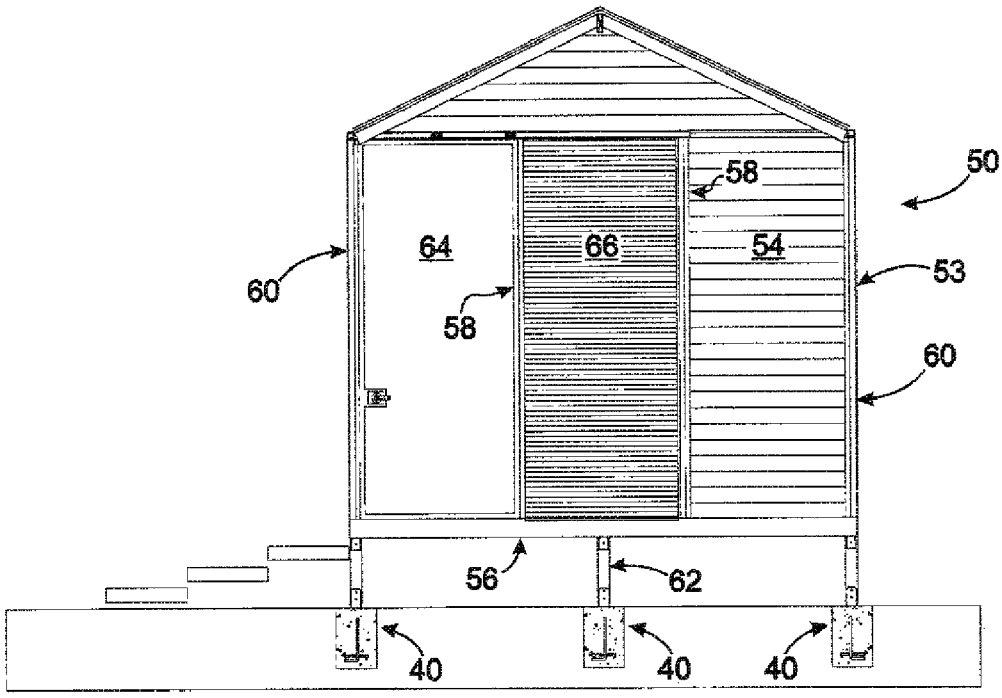
FIG. 2B is a front elevation view of the building shown in FIG. 2A.

In FIGS. 2A and 2B there is shown another application of the wall system of the present invention embodied in a simple building 50 having four walls 52 one of which is illustrated in FIG. 2A and one of which is illustrated in FIG. 2B. The building may have a pitched roof although the roof construction may be flat, or various other architectural configurations. The floor of the building is raised off the ground. As shown in FIG. 2A, the wall 52 may include three panels, 54, each of which has a generally rectangular configuration. The building floor is shown at 56 and is of conventional construction. The wall 52 includes four posts, two of which at 58 are intermediate and frame the center panel 54. The corners of the building 50 have posts 60. The corner posts 60 are embedded in the anchoring structure such as that shown at 40 in FIG. 1. The floor 56 of the building 50 may be additionally supported by short pillars 62 attached to the floor 56 and embedded in an anchoring structure such as at 40.

The front elevation view shown in FIG. 2B illustrates that the wall 53 may also comprise three panels one of which is similar to panel 54, one of which is a door 64, and one of which comprises a sliding panel 66. The door 64 may be constructed of glass. Panel 66 is mounted on tracks and may be moved so as to cover the door 64 exposing an additional panel such as 54 not shown in FIG. 2B since it is behind sliding panel 66. The wall 53 includes at the corners the two posts 60 as shown in FIG. 2A. Door panel 64 may be constructed so as to open on hinges as will be described in conjunction with FIG. 11, or may be slidable. The door 64 is framed by posts which will also be described in FIG. 11. The panel 54 has a post 58 spaced apart from the post 60. The panel 66 has post members 58 that attach to a top rail and a bottom rail.

It will therefore be appreciated that the wall system of the present invention may be used in various applications including but not limited to fences and building sidewalls. The wall system may comprise one or more panels each of which are attached to a post that clamps and retains the vertical end portions of the panel. It will also be appreciated from these illustrations that the wall system may comprise a flat wall or two walls that form a corner. As will be described below, the walls may be oriented with respect to a post so as to radiate in four directions as may be desirable in certain applications and is described in greater detail in reference to FIGS. 9 and 10.

Figure 3:
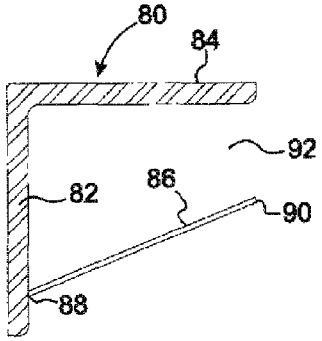
FIG. 3 is a sectional view of one embodiment of a post constructed in accordance with the present invention.

The post of the wall system of the present invention may be rendered in various embodiments and these will now be described and those of ordinary skill in the art will appreciate that the different configurations may be suitable for various wall configurations and thus will meet a large variety of applications for wall systems. FIG. 3 illustrates a first embodiment of a post 80 of the present invention, shown in section, and comprising two elongated substantially flat structural members that in this embodiment define plates, a first plate 82, and a second plate 84 that are attached or joined along their longitudinal proximal edges at an angle of substantially 90° at a first lateral location. The post 80 has a third elongated substantially flat member 86 attached at its proximal longitudinal edge 88 to structural plate 82 along a vertical line that is laterally spaced from the intersection of plates 82, 84 and forms an acute angle with plate 82. In this embodiment, the third elongated flat member 86 is resilient and defines a biasing member. The word "bias" is used to denote the force that arises when a resilient member at rest is forcibly displaced; a "biasing member" is one that is made of resilient material, in whole or in part, that when deflected will apply a restoring force against the source of deflection. When a biasing member is spaced from a fixed member or another biasing member and an object is placed between such member that displaces or alters the position of the biasing member at rest, the biasing member or members will clamp the object with a force that resists removal of the object. The word plate means a substantially flat elongated member that, relative to a biasing member has more resistance to elastic deformation thus providing structural strength to the post; the resistance may be due to the thickness of the member(s), type of material or other factors that affect the modules of elasticity. The distal edge 90 of biasing member 86 is spaced from the elongated substantially flat structural plate 84 at a pre-determined dimension, distance or space shown at 92. At least a portion of biasing member 86 is resilient and biases the distal edge 90 toward the structural plate 84 for the purpose to be described.

Figure 4:
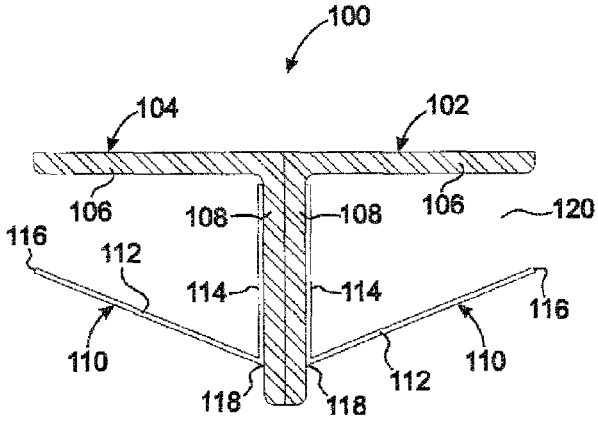
FIG. 4 is a sectional view of a second embodiment of a post.

FIG. 4 shows a second embodiment of a post 100 adapted to hold two panels in coplanar relationship comprised of two joined subassemblies 102 and 104 which may be used to vertically support two in-line panels. Post subassembly 102 comprises at least two elongated substantially flat structural plates 106, 108 attached along their proximal longitudinal edges at an angle of substantially 90° as in the embodiment of FIG. 3. Post subassembly 102 additionally includes at least one elongated V-shaped member 110 that includes a biasing member 112 that comprises one leg of the V-shaped member 110 attached to a second leg 114 that is fixedly attached to the substantially flat structural plate 108. Holding member 112 has a distal end 116 and is similar to holding member 86 as shown in FIG. 3 except that the proximal vertical edge of the holding member 112 is attached to the second leg 114 of V-shaped member 110 which in turn is attached to structural member 108. In this second embodiment, the proximal edge 118 of holding member 112 is also laterally spaced from structural member 106 a pre-determined lateral distance greater than the distal edge 116 of biasing member 112 with respect to structural plate 106. It will be readily understood by those having ordinary skill in the art that subassembly 104 of the second embodiment 100 is identical to subassembly 102 but allochirally oriented with respect to subassembly 102. It will also be understood that the subassembly 102 may be used alone at the end of a wall, like post 80. Thus, it will be unnecessary to describe the elements that comprise subassembly 104. Moreover, the two longitudinally extending flat plates 106, 108 may be integral, such as a common "angle iron" or L-shaped extrusion.

Figure 5:
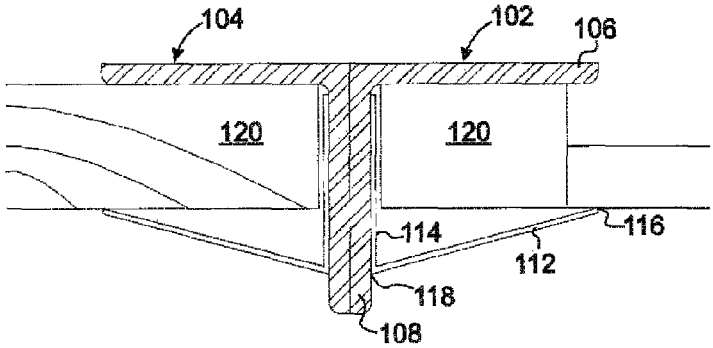
FIG. 5 is a sectional view of the embodiment of the post showing the panel and post in fixed relationship.

In FIG. 5, the second embodiment of FIG. 4 is shown in combination with two wall panels having vertical end portions 120. With attention drawn to subassembly 102, it will be seen that the end portion 120 is held between the elongated substantially flat structural plate 106 and biasing member 112. The biasing member 112 is, all or a portion, resilient and biases the distal edge 116 toward structural plate 106. Since a portion of biasing member 112 is resilient, distal edge 116 is positionally altered when the panel end portion is forced between the distal edge 116 and flat plate 106 because the distance 92 is less than the thickness of the wall panel end portion 120 whereby the end portion is clamped and retained between the holding member 112 and the flat structural plate 106. It will therefore be appreciated that the biasing force of the clamping structure portion of member 112 will securely retain the end portion of the panel and thus the panel itself in engagement with the post 100 without requiring any fasteners, glue, welding, or other similar methods for retaining two elements in fixed relationship. There is no requirement for any specialized tools to engage the wall panel with a post obviating the need for expensive assembly tools such as drills, welding equipment, glue dispensers, or the like.

Figure 6:
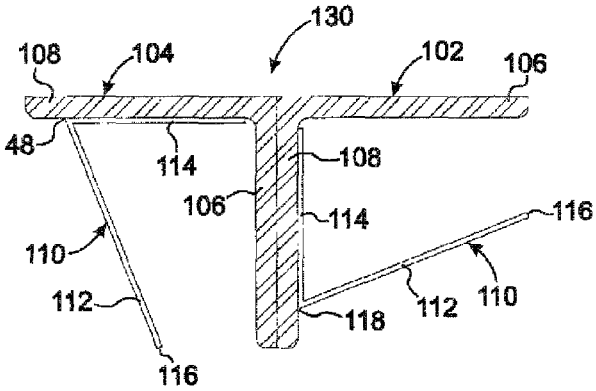
FIG. 6 is a sectional view of a third embodiment of a post.
Figure 8:
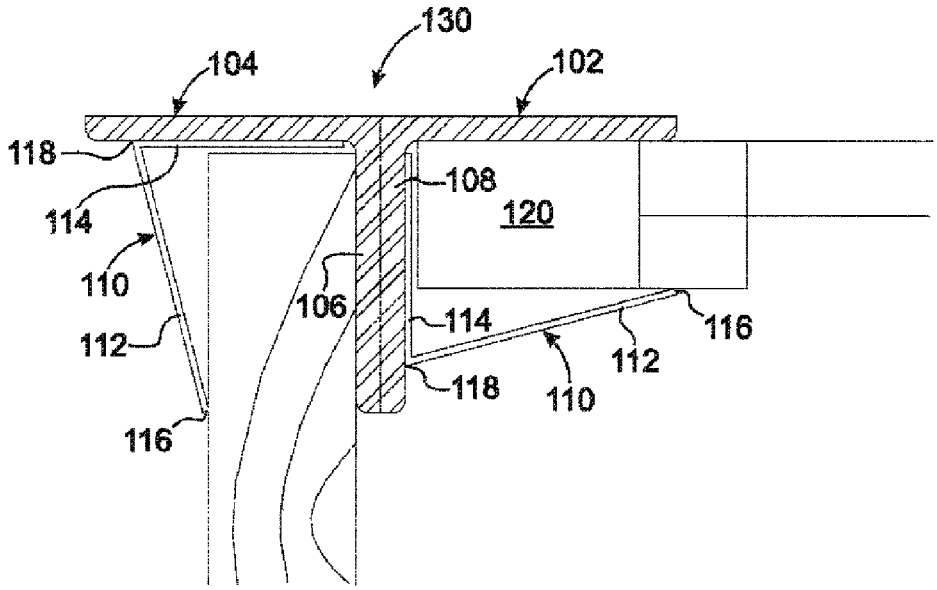
FIG. 8 is a sectional view of the post shown in FIG. 6 with the vertical end portions of a wall panel retained by the post.

A third embodiment of a post 130 comprises two subassemblies, 102, 104 that are identical to one another and also to the subassemblies, 102, 104 in the second embodiment shown in FIG. 4. However, in FIG. 6, the subassembly 104 has been reoriented so that structural plate 106 of subassembly 104 is attached to structural plate 108 of subassembly 102 as compared to the orientation of the subassemblies 102, 104 in FIG. 4. By reorienting subassembly 104 the post 130 is suitable for a corner as shown in FIG. 8.

Figure 7:
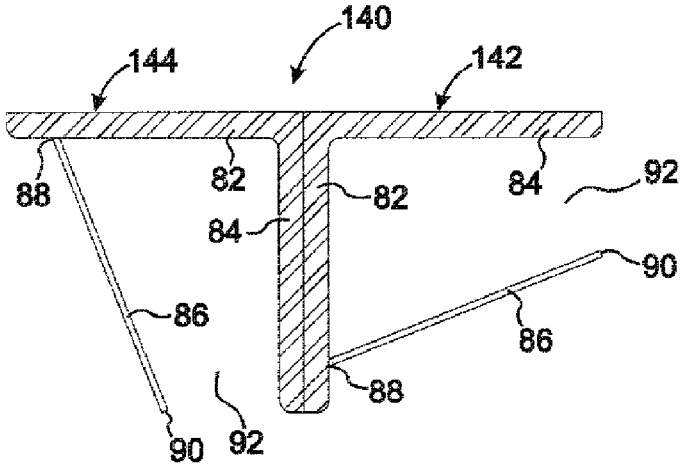
FIG. 7 is a sectional view of a fourth embodiment of a post.

FIG. 7 shows a fourth embodiment of a post 140 comprising post subassemblies 142 and 144. Subassembly 142 is identical in all respects to post member 80 shown in FIG. 3. Thus, subassembly 142 includes a first elongated substantially flat structural plate 82 and a second structural plate 84 intersecting along their longitudinal edges at an angle of substantially 90°. An elongated substantially flat member 86 is attached at a proximal longitudinal edge 88 to structural plate 82 along a vertical line laterally spaced from the intersection of plates 82 and 84 and having a distal edge 90 spaced from the structural plate 84 so as to define a predetermined space 92. Member 86 is formed of resilient material and defines a biasing member. The embodiment 140 has an additional subassembly 144, identical to subassembly 142, but oriented such that when wall panels are inserted and clamped into the biasing member and clamping structure of post members 142, 144 the panels will be oriented in a 90° or orthogonal position. Comparing the fourth embodiment in FIG. 7 to the third embodiment in FIG. 6 it will be appreciated that the difference is that post 140 in FIG. 7 has subassemblies 142 and 144 that are identical to post 80 in FIG. 3 whereas the fourth embodiment 130 in FIG. 6 has subassemblies members 102, 104 identical to those shown in FIG. 4.

Figure 9:
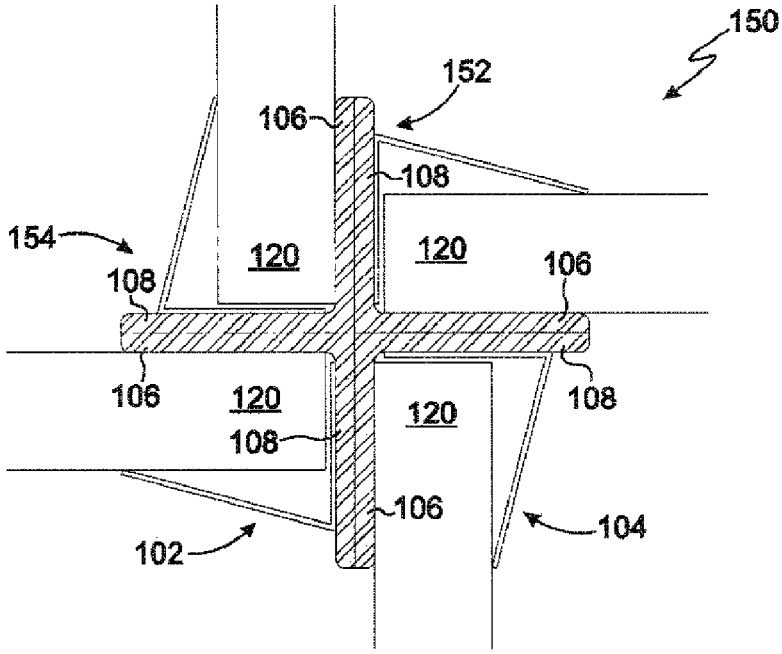
FIG. 9 is a sectional view of a fifth embodiment of a post.

In FIG. 9, there is a fifth embodiment, post 150, comprising a four-way juncture for four wall panels the end portions of which are shown at 120. With reference to FIG. 4, it will be seen that post 150 comprises four subassemblies, identical to subassemblies 102 and 104 shown in FIG. 6 and an additional two subassemblies 152, 154 which are identical in all respects, other than orientation, to subassemblies 102, 104.

Figure 10:
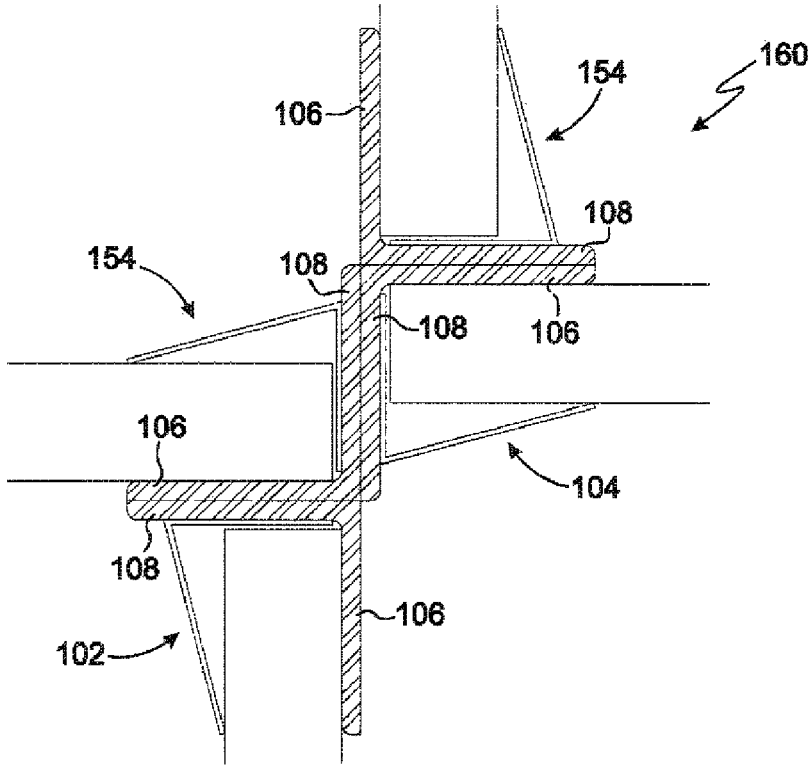
FIG. 10 is a sectional view of a sixth embodiment of a post.

In FIG. 10, a sixth embodiment of a post is shown at 160 comprising the four subassemblies 102, 104, 152 and 154 shown in FIG. 9 oriented such that the structural member 108 of subassembly 154 and 106 of subassembly 104 are joined back-to-back and structural members 108 of subassemblies 104 and 154 are joined back-to-back while structural member 106 of subassembly 154 is joined to structural member 108 of subassembly 102 back-to-back. Thus the four-way post in FIG. 10 orients the four panels in a cross configuration as in FIG. 9 but the subassemblies 102 and 154 panel end portions are spaced from one another a lateral distance equal to the width of structural plate 108.

Figure 11A:
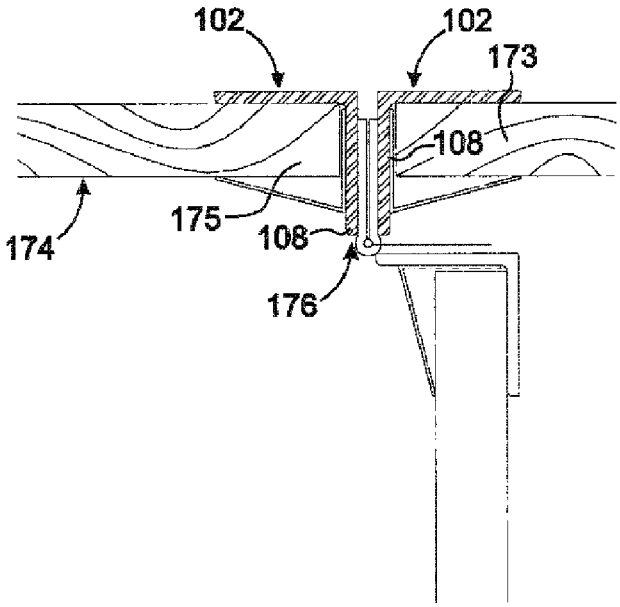
FIG. 11 is a sectional view of a pair of posts showing a hinged panel and portions of two adjacent panels.
Figure 11B:
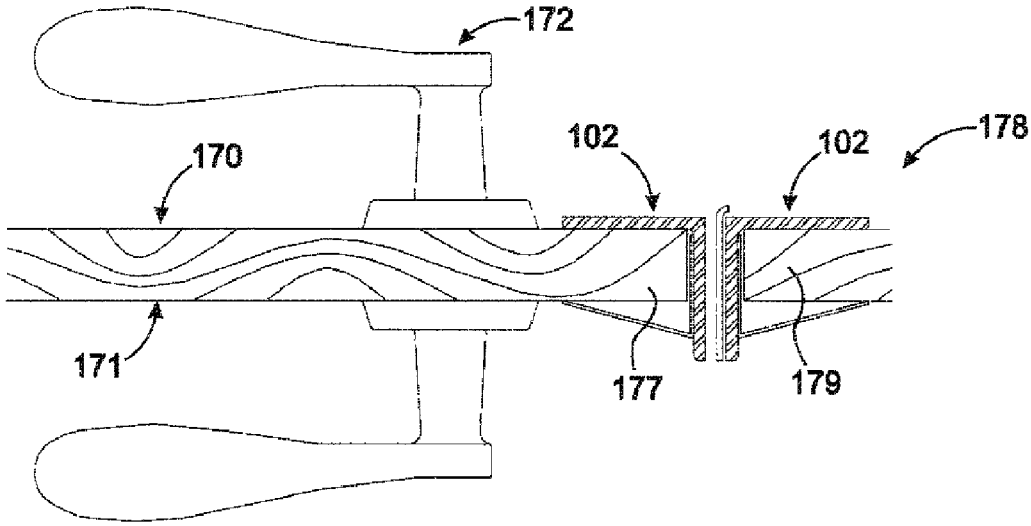

In FIGS. 11A and 11B, it will be seen that a fence may be provided with a gate, or a building may be provided with a door, by using the posts as shown in any of the previous embodiments, first through fourth. Specifically, the door or gate 179 includes a panel 171 with a door handle assembly indicated generally at 172. As seen in FIG. 11A, one end 173 of panel 170 is retained in a subassembly 102 and the adjacent fixed wall panel 174 has an end 175 retained by a second subassembly 102 which are of course identical in construction but oriented so as to receive a panel from the left rather than the right. A hinge 176 is positioned between structural plates 108 of the two post members 102. At the opposite end of panel 171, as seen in FIG. 11B the end portion 177 is retained in a post member 102 that is oriented in the same direction as post member 102 that engages panel 174 by retaining end portion 175. The fixed wall section 178 adjacent to the end 177 of panel 171 has an end portion 179 received and retained by a second post member 102 oriented 180° to post member 102 that retains end portion 177 of door or gate panel 171.

Figure 12:
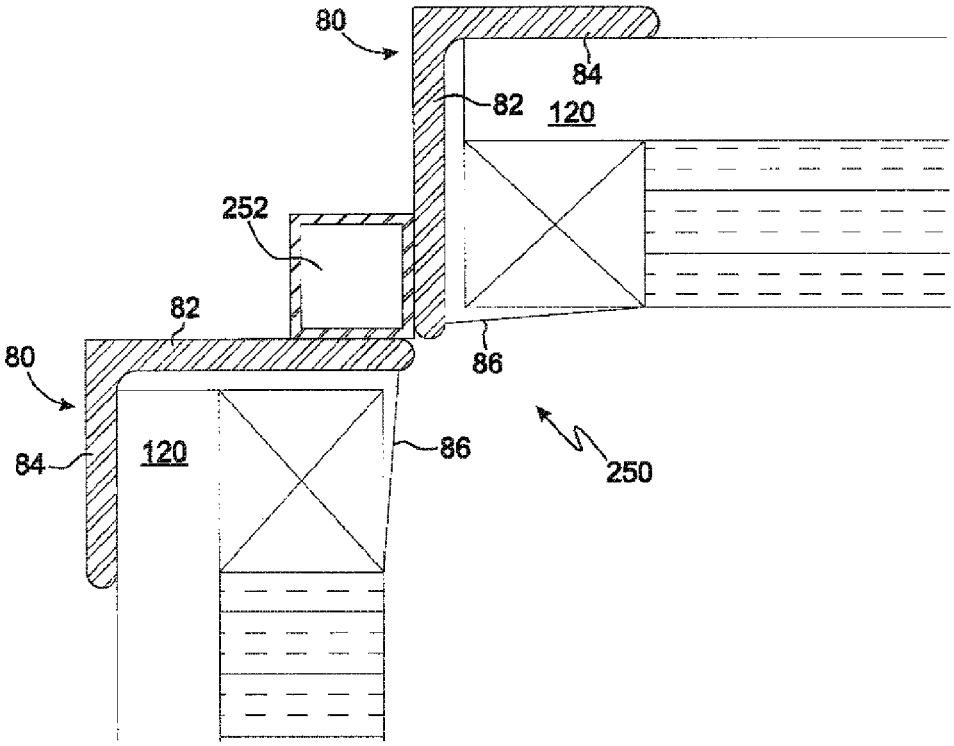
FIG. 12 is a sectional view of a seventh embodiment of a post.

FIG. 12 shows a seventh embodiment of a post 250 suitable for a corner. This embodiment shows two subassemblies, each identical to member 80 shown in FIG. 3. Each of the posts 80 includes substantially flat elongated structural plates 82 and 84 as well as a biasing member 86. The vertical end portion 120 is clampingly engaged between the structural plate 84 and the biasing member 86. In order to fix the two plate members 82 in a right angle configuration, there is provided a reinforcement tube 252 that attaches on one face to plate 82 of one of the subassemblies 80 and on another face to the plate 82 of the second subassembly 80.

Figure 13A:
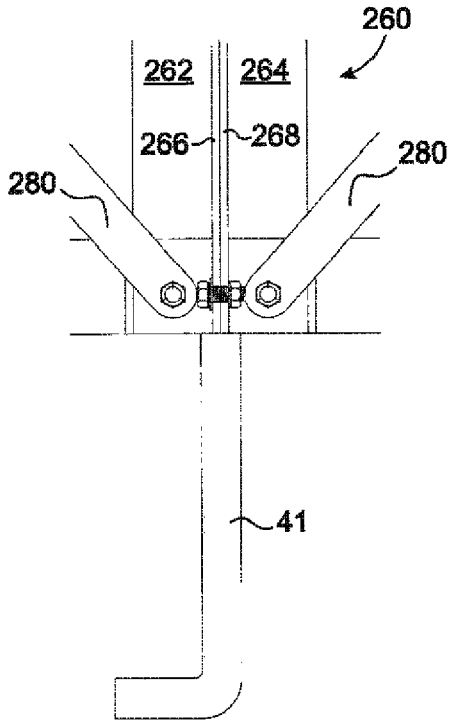
FIGS. 13A, 13B, 13C and 13D show details of one embodiment of cross members and anchoring structure of a post.
Figure 13B:
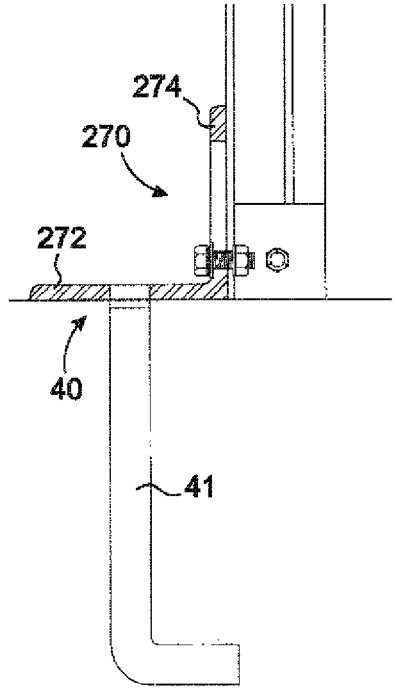
Figure 13C:
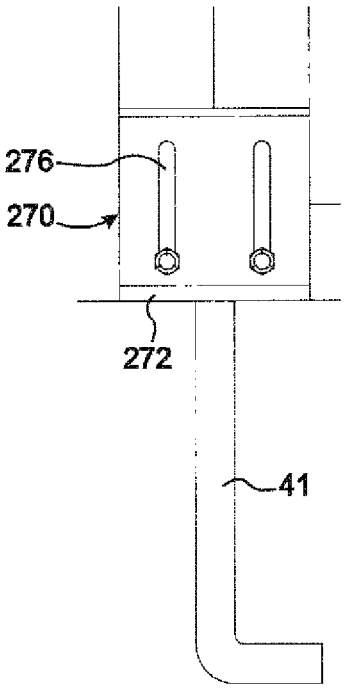
Figure 13D:
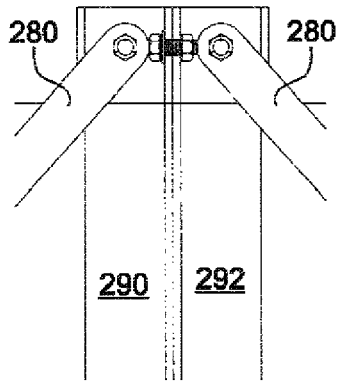

FIGS. 13A-13D show the details of the termination of the cross members (beams, straps or wires) at the bottom and top of a post 260. Post 260 includes two subassemblies 262 and 264 having their structural plates 266 and 268 attached back-to-back so as to form a T-cross section post as shown in FIG. 5. Mounting structure 40 includes an L-shaped post base 41 that may be embedded in concrete 42 (see FIG. 1). The L-shaped member, may comprise a round bar bent at a 90° angle at its lower end and at its top end is secured by welding or the like to an angle iron 270 having a leg 272 horizontally disposed and a vertically disposed leg 274 having a slot 276 as seen best in FIG. 13C which together with fasteners permit the post to be vertically adjusted relative to the anchoring structure. A pair of diagonally oriented cross beams 280 are attached to post members 262 and 264 and at their upper end to two identical post members 290, 292 as seen in FIG. 13D. This particular anchoring structure is highly suitable for use of the wall system as a fence and the cross beams are structurally desirable where wind or other forces must be resisted by the wall system.

Figure 14:
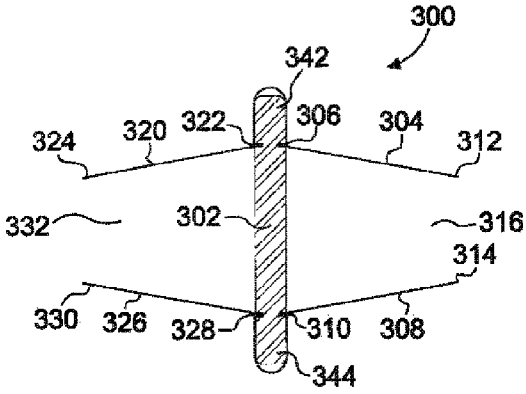
FIG. 14 is a sectional view of an eighth embodiment of a post.

FIG. 14 shows an eighth embodiment of a post 300 for the wall system of this invention. The cross section of FIG. 14 shows a first elongated substantially flat member in the form of a structural plate 302 disposed in a vertical position when in use. A second elongated substantially flat member 304 is attached at its longitudinal proximal edge 306 to structural plate 302. A third elongated substantially flat member 308 is attached at its proximal longitudinal edge to said structural plate 302 so that the distal longitudinal edges 312, 314 of biasing members 304, 308 define a predetermined space or distance 316. In post 300, the second and third flat members 304, 308 are formed from resilient material and define biasing members. FIG. 14 also shows that the post 300 may be used as a post in an in-line wall by including a biasing member 320 attached to the structural plate 302 at 322 and having a distal end 324. Similarly, opposite the biasing member 308 there may be a biasing member 326 attached to structural plate 302 at 328 and having a distal end 330 which, together with distal end 324 of biasing member 320, defines a space 332 identical to space 316.

Figure 15:
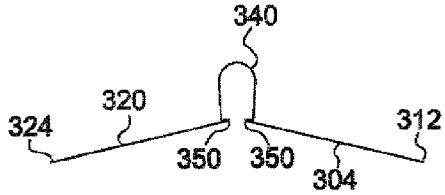
FIG. 15 illustrates the biasing member shown in FIG. 14.

As shown in FIG. 15, the biasing members 304, 320 (and similarly the biasing members 308 and 326) may be formed from a single resilient sheet of material which has a central region 340 that complements the shape of the vertical end portions 342 and 344 of structural plate 302. Structural member 302 is provided with a pair of longitudinally extending notches on opposite sides of structural plate 302 spaced laterally inwardly from the edge of the end portions 342 and 344 of structural plate 302. The biasing member comprising the sections 304, 320 and 340, at the point at which the biasing members 304 and 320 connect to the central portion 340, define ridges at 350 that are spaced apart a distance less than the thickness of the end portions of structural plate 302. To assemble the post 300, the biasing member 304, 320 and 340 is forcibly pushed over the longitudinal end 342 of structural plate 302 until the ridges 350 snap into the vertical notches in the opposite faces of structural plate 302. It will therefore be appreciated that when assembled, the space 316 defined by the distal ends 312, 314 of biasing members 304 and the space 332 defined by the distal ends 324, 330 of biasing members 320, 326 is less than the thickness of the end portion of a panel that may be inserted between the biasing members to thereby firmly clamp the end portion of the panel to the post 300.

Figure 16:
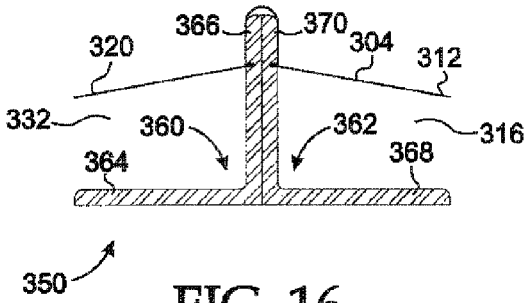
FIG. 16 is a sectional view of a ninth embodiment of a post showing the use of the biasing member in FIG. 15.

FIG. 16 shows a ninth embodiment of the invention, a post 350, in which the biasing member 304, 320, 340, as shown in FIG. 15 and described above is used in conjunction with two structural subassemblies 360, 362 the former comprised of first and second flat members 364, 366 attached at one longitudinal edge to form the L-shaped subassembly 360 comprised of first and second flat members 368, 370 attached at one longitudinal edge to form the L-shaped subassembly 362. The L-shaped subassemblies are attached back-to-back. The exposed surfaces of flat members 366, 370 have a longitudinally extending notch as in the embodiment of FIG. 14. The clip is then inserted over the free ends of legs 366, 370 until the ridges 350 snap into the notches in the respective flat members or legs 366, 370. Accordingly, the ninth embodiment post 350 comprises elongated substantially flat structural members 366 and 370 of L-shaped subassemblies 360, 362, a substantially flat biasing member 304 attached at a proximal edge through the interconnection of ridges 350 with the notches in members 366, 370, and an additional elongated substantially flat structural member 368 attached at its proximal longitudinal edge to member 370 so as to define a predetermined space 316 for receiving and clamping the vertical end portion of a wall panel.

It will therefore be seen that in the embodiment shown in FIG. 14 the end portion of the panel is clamped between the distal edges 312, 314 of biasing members 304 and 308 whereas in the ninth embodiment of FIG. 16 the end portion of the panel is inserted in the space 316 so that the distal end 312 of biasing member 304 will clamp the end portion of the panel against member 368 of L-shaped subassembly 362 that comprises post 350. In one case the panel is clamped between two biasing members, and in the other, between one biasing member and one structural member as in the embodiments shown in FIGS. 3-10, 12 and 14-16. Of course, the clamping force can be adjusted to be equal if desired. The clamping force can be altered by a change in material, material thickness, or the pre-selected dimension between the biasing member distal edge and the adjacent biasing or structural member.

Figure 17:
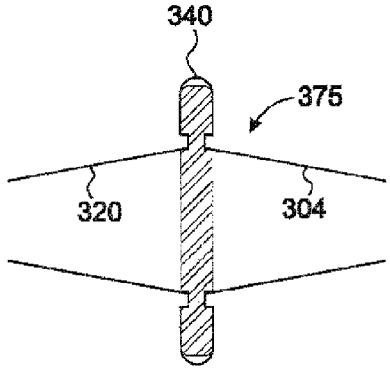
FIG. 17 is a sectional view of a tenth embodiment of a post.
Figure 18:
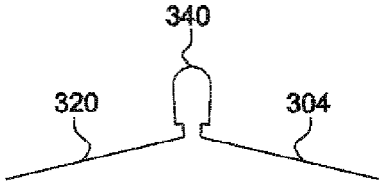
FIG. 18 illustrates the biasing member of the embodiment shown in FIG. 17.
Figure 19:
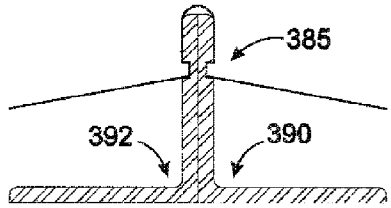
FIG. 19 is a sectional view of an eleventh embodiment of a post.

FIGS. 17, 18 and 19 are similar views to FIGS. 14, 15 and 16 showing a tenth embodiment 375 again comprising the same components, i.e., biasing member 304, 340 and 324, formed as a single piece from a single sheet of resilient material and a structural member 302. However, post 375 has a different ridge and notch engagement structure but to effect the same result. The post 375 in FIG. 17 may also be configured, similar to FIG. 16, as an eleventh embodiment, post 385 (FIG. 19), so as comprising two L-shaped subassemblies 390, 392.

Figure 20:
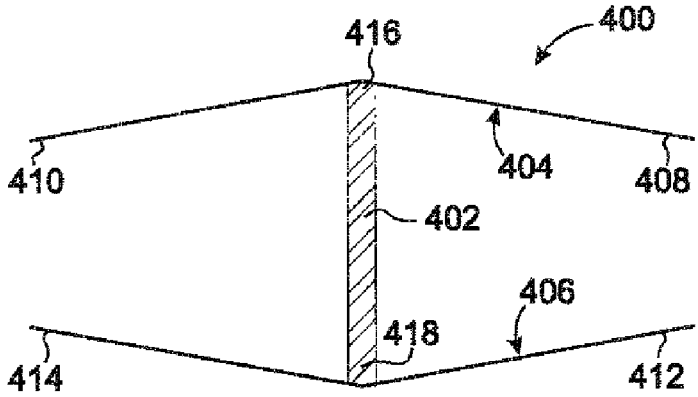
FIG. 20 is a sectional view of a twelfth embodiment of a post.
Figure 21:
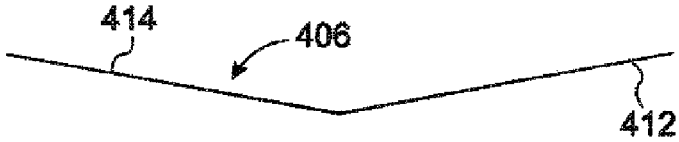
FIG. 21 illustrates the biasing member of the embodiment shown in FIG. 20.

In FIG. 20 a twelfth embodiment 400 of the invention is shown in cross section. The post 400 includes an elongated substantially flat structural plate 402, that in use, is vertically disposed. Two biasing members 404, 406 are configured, as seen best in FIG. 21 as a shallow V-shaped resilient member comprising two resilient flat members 412, 414 that intersect at an obtuse angle. The biasing member 404 comprises resilient flat members 408, 410 and is identical to the biasing member 406. The center section of the biasing members 404 and 406, are secured to the end portions 416, 418 of plate 402 in a permanent manner such that the distal ends of the wings 408, 412 are spaced a predetermined distance, equivalent to the distance between the distal ends of the biasing members 410, 414 on the opposite side of the structural plate 402. In the preferred embodiment, the obtuse angle between the wings 412, 414 and 408, 410 is 160°. Depending upon the material of the structural plate 402, and the material of the biasing members 404 and 406, if made of metal, they may be attached by welding, spot welding, brazing, or other metal joining technique. Alternatively, the entire post may be extruded as a single integral piece, cut off in selected lengths. If the V-shaped resilient member and structural plate are formed of non-metallic material, they may be attached by various methods including glue or may be pultruded as a one-piece integral component. Alternatively, regardless of the material the resilient members and structural plate may be jointed with fasteners.

Figure 22:
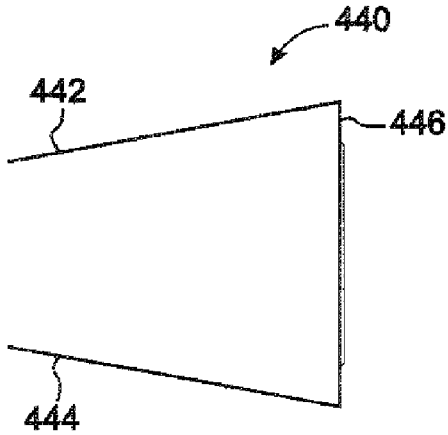
FIG. 22 is a sectional view of a thirteenth embodiment of a post.
Figure 23:
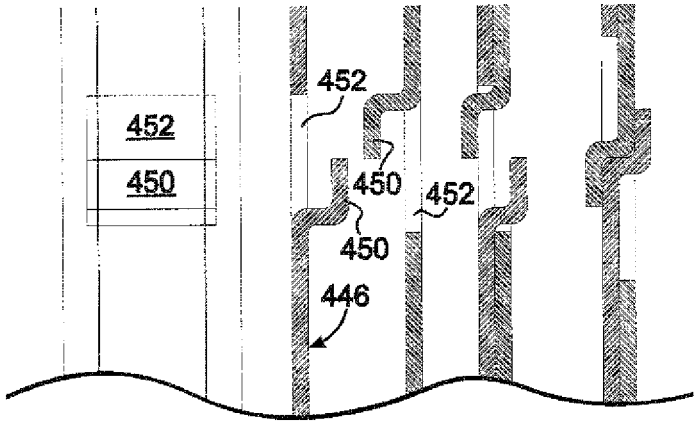
FIG. 23 is a right side elevation view of the embodiment shown in FIG. 22.
Figure 24:
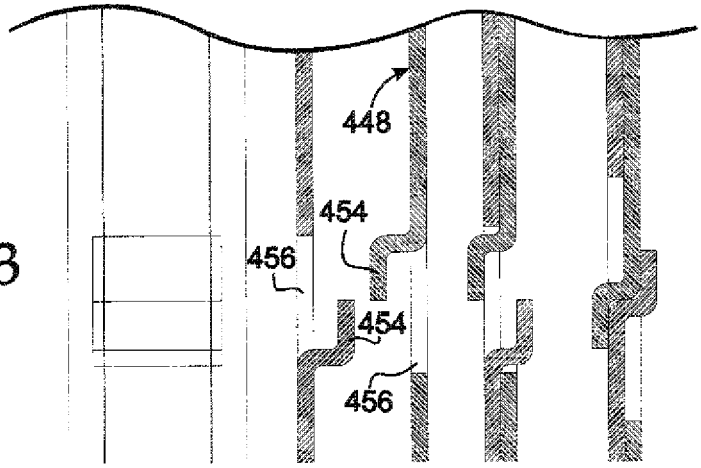
FIG. 24 is a vertical sectional view of the thirteenth embodiment shown in FIG. 22.
Figure 25:
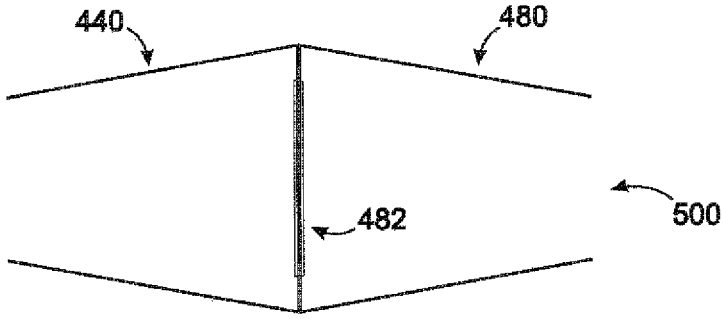
FIG. 25 is a sectional view of a fourteenth embodiment of a post.

Referring to FIGS. 22-25, a thirteenth embodiment of the invention, post 440, is shown in FIG. 22 comprising a generally U-shaped member including a pair of substantially flat biasing members 442 and 444 that are attached at their longitudinal edges to base member 446 or may be formed from a single sheet of resilient material bent to the configuration shown. The base member 446 is shown in a front elevation view in FIG. 23 and in a series of sectional views in FIG. 24 illustrating the joining of the components of the post 440. The post 440 base member 446 has an interlocking structure comprising a cleat 450 that is stamped out of the base member leaving an opening 452. In a preferred embodiment of the post 440, fabricated from metal, the distance between the adjoining openings 452, 456 and cleats 450, 454 may be on the order of six inches. It will be understood by those of ordinary skill in the art that a post 440 may be combined with an identical post 480, as shown in FIG. 25 as subassemblies to comprise the post 500. The subassemblies may be connected back-to-back to form a structural member by inverting one of the subassemblies to the position shown at 448 in FIG. 24 permitting the base member 446 of subassembly 440 to interconnect or interlock with the base member 446 of subassembly 480. Alternatively, the two base members 446 could be attached back-to-back with fasteners, glue, welding or the like. After assembly, the post 500 comprising interlocked pairs of subassemblies 440 and 480 has the same sectional configuration as the post 400 as shown in FIG. 20. The two layers of base member 446 from subassemblies 440 and 480, by doubling the thickness of the base members, provides a substantially flat structural plate as shown at 482.

Figure 26:
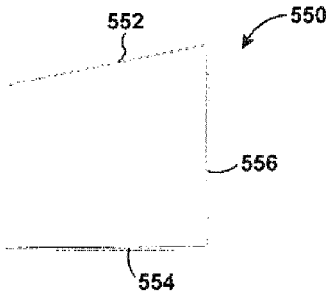
FIG. 26 is a sectional view of a fifteenth embodiment of a post.
Figure 27A:
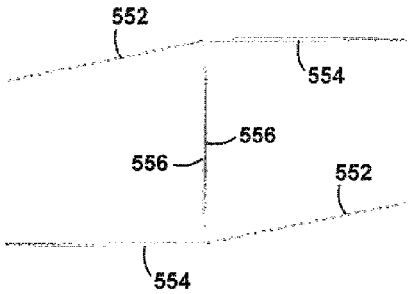
FIGS. 27A-27D are sectional views of the fifteenth embodiment in various combinations.
Figure 27B:
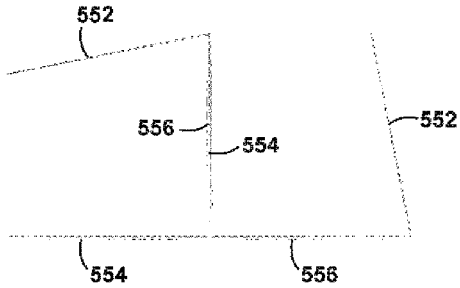
Figure 27C:
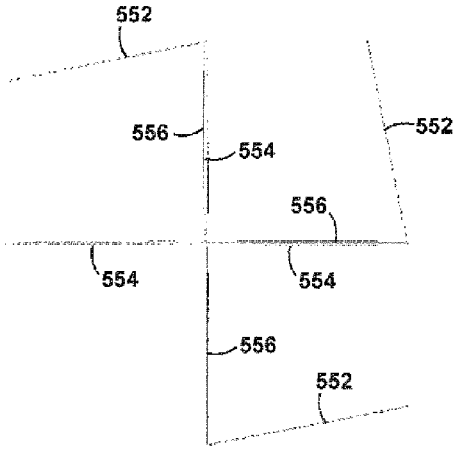
Figure 27D:
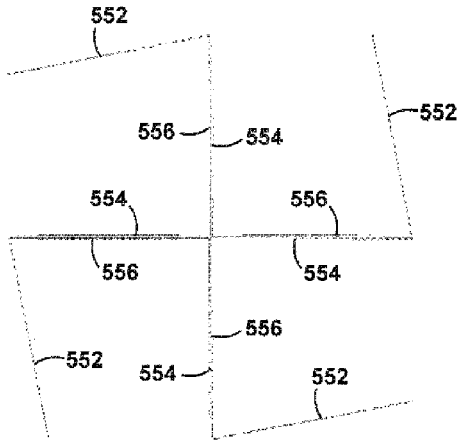

Post 440 may be varied so that the interlocking structure is formed in one or more than one of the three resilient members as shown on post 550 in FIG. 26. With interlocking structure on two of the resilient members, the subassembly of FIG. 26 may be combined and arranged in various configurations such as those shown in FIGS. 27A-27D. The post 550 as shown in FIG. 26 has three resilient members 552, 554, and 556. 556 comprises the base member comparable to the base member in FIG. 22; however, base member 556 is attached to resilient member 554 at a right angle whereas resilient member 552 is attached at an acute angle. Base 556 and biasing member 554 each have interlocking structure as described in reference to FIGS. 23 and 24. The post 550 may be used alone as an end post for a wall. As seen in FIG. 27A, two posts identical to post 550 may be interlocked at bases 556 so as to form a post suitable for an inline connection of panels in a wall system. In FIG. 27B, two posts 550 are oriented so as to form a corner post. In FIG. 27C, three posts 550 are arranged so as to provide both a right angle or corner post as well as an inline post. And finally, as shown in FIG. 27D, there are four posts 550 arranged so as to form a four-way corner similar to that shown in FIG. 9. Thus, it will be apparent to one of ordinary skill in the art that a wide variety of posts can be configured from the single post 550 as may be desirable for various applications of a wall system. An advantage of the post shown in FIGS. 22-27 is that the U-shaped elongated structures are formed from a single thickness of material and thus may be suitable for fabrication by bending a flat sheet of metal without requiring any welding or similar means for attaching two of the resilient members to a third.

It is to be understood that the invention is not limited to the exact details of construction, assembly, materials, or the many embodiments shown and described, as obvious modifications and equivalents will be apparent to one skilled in the art. As noted above, various types of material may be used. Furthermore, the wall system, including the post members and panel, are scalable such that panels of various thickness may be used in accordance with the invention for applications where the wall system is intended to provide a building wall that is sufficiently thick and of a type of material that provides insulation, noise suppression, and the like. As also indicated above, a panel may be formed from glass so as to provide for a window when the wall system is used for building construction. It will also be understood that a wide variety of anchoring structures may be used for vertically supporting the wall system depending upon the application of the wall system, that is, when used as a fence or a building wall. Accordingly, the invention is therefore to be limited only by the scope of the appended claims.

I claim:

1. A wall system comprising:

at least two posts, each post having at least one subassembly comprising at least two elongated substantially flat structural plates intersecting along the longitudinal edges at an angle of substantially 90 degrees, said posts secured in vertical spaced apart positions by anchoring structure for maintaining each of said posts in a vertical position;

each subassembly having at least one elongated substantially flat biasing member attached at a proximal longitudinal edge to the first of said substantially flat structural plates along a vertical line laterally spaced from the intersection of said plates, the distal edge of said biasing member spaced from said second elongated substantially flat structural plate a pre-determined distance; and a generally rectangular wall panel oriented in a substantially vertical plane and having two opposite vertical end portions, each of said vertical end portions inserted between said biasing member and said second elongated substantially flat structural plate of each of said posts and clampingly retained therein.

2. The wall system of claim 1 wherein said anchoring structure comprises a concrete foundation set in the ground, the lower end of said post encased in said concrete.

* * * * *